US005421747A

United States Patent [19]

Agnihotri et al.

[11] Patent Number: 5,421,747

[45] Date of Patent: Jun. 6, 1995

[54] CONNECTOR ASSEMBLY

[75] Inventors: Ram K. Agnihotri, Harrisburg; Thomas J. Lynch, Mechanicsburg; James W. Robertson, Oberlin, all of Pa.

[73] Assignee: The Whitaker Corporation, Wilmington, Del.

[21] Appl. No.: 218,963

[22] Filed: Mar. 28, 1994

[51] Int. Cl.[6] ..... H01R 13/405

[52] U.S. Cl. ..... 439/736; 439/722

[58] Field of Search ..... 439/404–409, 439/395, 722, 736

[56] References Cited

U.S. PATENT DOCUMENTS

| | | | |
|---|---|---|---|
| 2,592,552 | 4/1952 | De Florez et al. . | |
| 2,680,145 | 6/1954 | Lanfear . | |
| 2,908,884 | 10/1959 | Wirsching . | |
| 2,924,807 | 2/1960 | Field . | |
| 3,259,968 | 7/1966 | Dyksterhouse . | |
| 3,351,889 | 11/1967 | Lawlor et al. . | |
| 3,659,340 | 5/1972 | Giedd et al. | 29/627 |
| 3,664,018 | 5/1972 | McGregor | 29/629 |
| 3,877,773 | 4/1975 | Doty et al. | 339/97 P |
| 4,015,117 | 3/1977 | Wicklund, Jr. | 250/208 |
| 4,157,208 | 6/1979 | Roberts et al. | 339/98 |
| 4,171,861 | 10/1979 | Hohorst | 339/198 G |
| 4,186,984 | 2/1980 | Reavis, Jr. et al. | 339/103 R |
| 4,283,105 | 8/1981 | Ferrill et al. | 339/97 R |
| 4,431,247 | 2/1984 | Abdullah et al. | 339/97 R |
| 4,515,336 | 5/1985 | Fischer | 248/288.3 |
| 4,536,049 | 8/1985 | Wilmes | 339/97 R |
| 4,637,675 | 1/1987 | Loose | 339/97 R |
| 4,641,225 | 2/1987 | Reichle | 361/429 |
| 4,684,765 | 8/1987 | Beck et al. | 174/68.5 |
| 4,705,340 | 11/1987 | Loose | 439/395 |
| 4,734,061 | 3/1988 | Randall, Jr. et al. | 439/709 |
| 4,767,338 | 8/1988 | Dennis et al. | 439/55 |
| 4,795,363 | 1/1989 | Scherer et al. | 439/395 |
| 4,795,364 | 1/1989 | Frantum, Jr. et al. | 439/407 |
| 4,831,726 | 5/1989 | Moly | 29/857 |
| 4,899,257 | 2/1990 | Yamamoto | 361/395 |
| 4,901,189 | 2/1990 | Merriman et al. | 439/722 |
| 4,929,190 | 5/1990 | Gonon et al. | 439/409 |
| 5,006,077 | 4/1991 | Loose et al. | 439/409 |
| 5,012,391 | 4/1991 | Schultz, Jr. et al. | 361/428 |
| 5,097,592 | 5/1992 | Schultz, Jr. et al. | 29/832 |
| 5,120,245 | 6/1992 | Robertson et al. | 439/395 |
| 5,219,302 | 6/1993 | Robertson et al. | 439/404 |
| 5,254,015 | 10/1993 | Robertson | 439/410 |

FOREIGN PATENT DOCUMENTS 1313037 11/1962 France .

OTHER PUBLICATIONS

AMP Quiet Front Terminal Block Catalog 90-923 Issued Apr. 1990 (1 page).

AMP Quient Front Terminal Blocks IS3206 Released Mar. 9, 1990 (pp. 1–4).

AMP Quiet Front Cross-Connect Terminal Closure 769147-1 IS 3217 Released Feb. 25, 1991 (pp. 1 & 2).

Cannon Polyurethane Technology "HE" (8 pages).

Tappi Journal "Principles of Waterjet Cutting" by Gary W. Ayers; Sep. 1987.

Compressed Air Magazine "Giving Water the Power to a Laser Beam".

"Water Jet Assumptions".

"Waterjet Gantry Shape Cutters".

Machine Design "Designing Insert-Molded Parts" by Harry P. Yorgensen, Jr.; Sep. 1988.

*Primary Examiner*—Larry I. Schwartz
*Assistant Examiner*—Jill DeMello
*Attorney, Agent, or Firm*—Katherine A. Nelson

[57] ABSTRACT

A sealed terminal block assembly (10) includes a harness assembly (78) having first electrical terminal members (30) terminated to wires (74) of a cable (72); a housing (12) molded around the harness assembly (78), with each first terminal member (30) associated with a cavity (18) of the housing; second terminal members (46) for electrically engaging a corresponding first terminal member (30) upon insertion of the second terminal member into cavity (18); and an actuator member for moving each second terminal member (46) into electrical engagement with a second wire (80) inserted into the first terminal member (30) from a wire receiving face (26) of the housing (12).

7 Claims, 9 Drawing Sheets

CONNECTOR ASSEMBLY

FIELD OF THE INVENTION

This invention relates to electrical connectors and more particularly to terminal block connectors having a stationary terminal member within the housing and a movable terminal member in a cap that is placed over the stationary terminal.

BACKGROUND OF THE INVENTION

Terminal blocks are commonly used within the telecommunications industry to interconnect telephone wires coming from the phone company to individual telephone lines in a selected locality. Telephone wires coming from the telephone company may be either in the form of buried cable or aerial wires. The terminal blocks are mounted in an enclosed pedestal affixed to the ground or in an aerial mount enclosure or on a pole. Although the terminal blocks are in enclosures, there is still a need to provide environmental sealing for the terminal block to minimize effects of high humidity and corrosion caused by air borne contamination such as salt in coastal areas, acid rain, pollution or the like.

U.S. Pat. No. 5,120,245, discloses a terminal block connector having a pluggable electrical connector secured in the bottom of the terminal block housing. The assembly is made by first forming a housing, inserting the stationary terminal members into respective silos of the housing, terminating wires of a cable to the connector and to the respective terminals and finally encapsulating the wires and interconnections in a potting material as known in the art. The potting material cooperates with the lower portions of the conductive stationary cylindrical terminals, the wires, and the electrical connector to provide an environmental seal. Even periodic flooding due to installation of the terminal blocking in diurnal coastal tidal flood plains is said to be successfully resisted by this design.

The potting material, however, typically has a different coefficient of thermal expansion than the materials normally used for connector housings and terminal block housings. Thus, when the terminal block is subjected to variations in heating and cooling, the potting material and housing material to become separated. Furthermore, the expense of additional materials, and the additional manufacturing steps associated with using potting material increase the cost of the resulting product.

It is desirable, therefore, to provide a terminal block connector that provides an environmental seal without requiring the secondary manufacturing step of the use of potting compound or the like.

SUMMARY OF THE INVENTION

The electrical connector or terminal block assembly of the present invention comprises a harness assembly including a cable having a plurality of wires extending therefrom, each wire being terminated to a plurality of first electrical terminal member, a housing molded around the harness assembly such that each terminal member is associated with a terminal receiving cavity within the housing, and a like plurality of second terminal members that are insertable into the cavities for electrical connection to the first terminal members, the second terminal members being movable from a first to a second position by moving an actuation member. The housing member further includes at least one wire receiving aperture associated with each of the first or stationary terminal members the aperture extending into the housing member from a wire receiving face thereof orthogonal to the path of movement of the second terminal members, the aperture being in communication with respective ones of the cavities. The second terminal members include at least one wire receiving opening in alignment with the wire receiving aperture when in the first position and a wire receiving slot extending parallel to the path from each said wire receiving hole for receiving a second wire thereinto when the second terminal member is moved to the second position to terminate the second wire. The terminations of the first wires to the first or stationary terminal members are sealed within the housing upon the molding thereof, thereby simplifying manufacturing and assembly of the connector or terminal block assembly.

In the preferred embodiment the first and second terminal members are cylindrical and are of the type disclosed in U.S. Pat. Nos. 5,120,245, and 5,254,015, and are used in Quiet Front terminal blocks available from AMP Incorporated. The housing made in accordance with the present invention is preferably molded from liquid polyurethane or the like using a reaction injection molding, (RIM).

It is an object of the present invention to provide a terminal block assembly having reliable environmental sealing.

It is also an object of the invention to provide a terminal block that minimizes the number of manufacturing steps while providing improved environmental sealing.

It is a further object of the present invention to provide a terminal block assembly having an integral strain relief for a cable.

It is also an object of the invention to provide a terminal assembly that is easy and cost effective to manufacture and assemble.

DETAILED DESCRIPTION OF THE DRAWINGS

Figure 1:
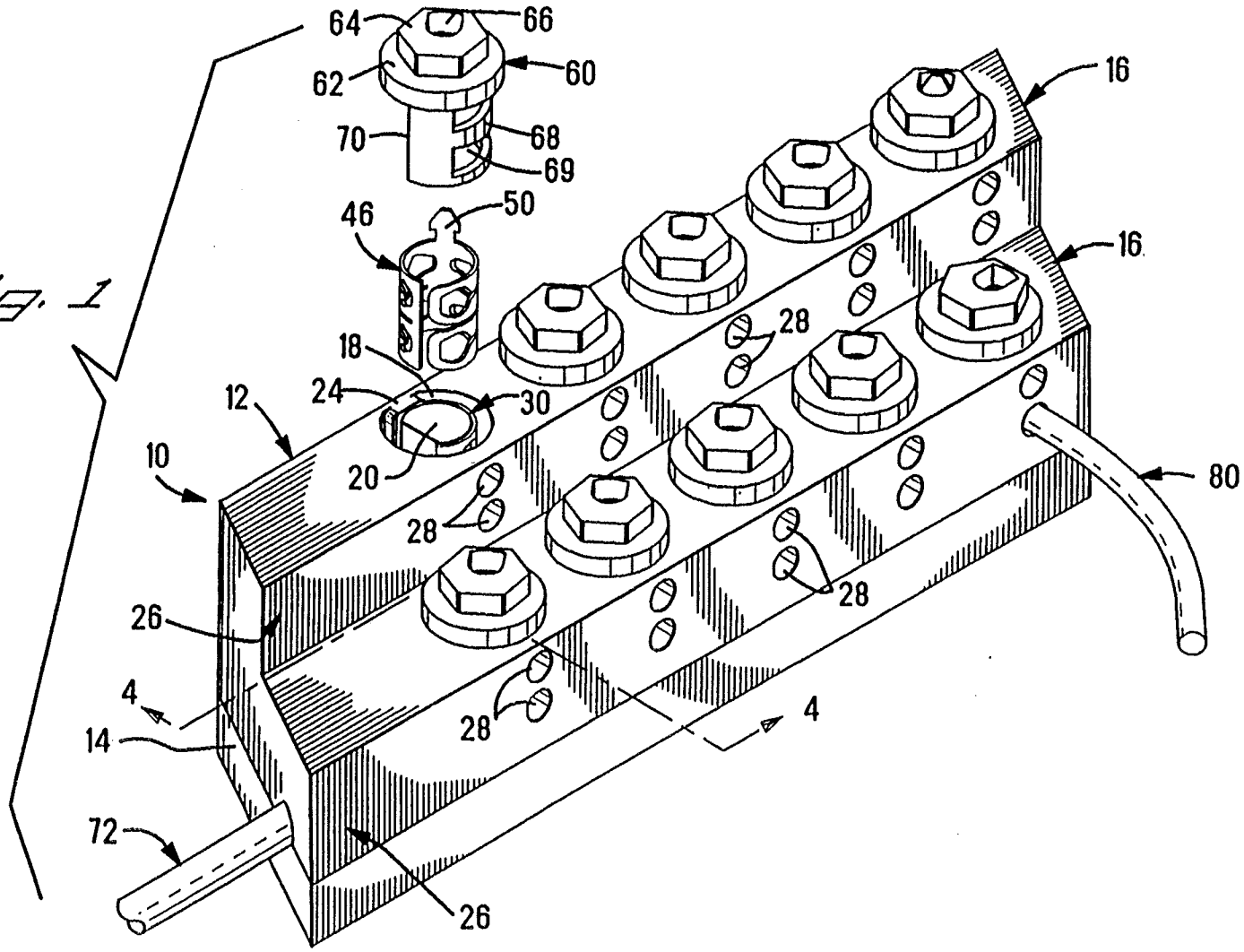
FIG. 1 is a perspective of a connector assembly made in accordance with the present invention, the assembly having some of the parts exploded from the terminal block.
Figure 2:
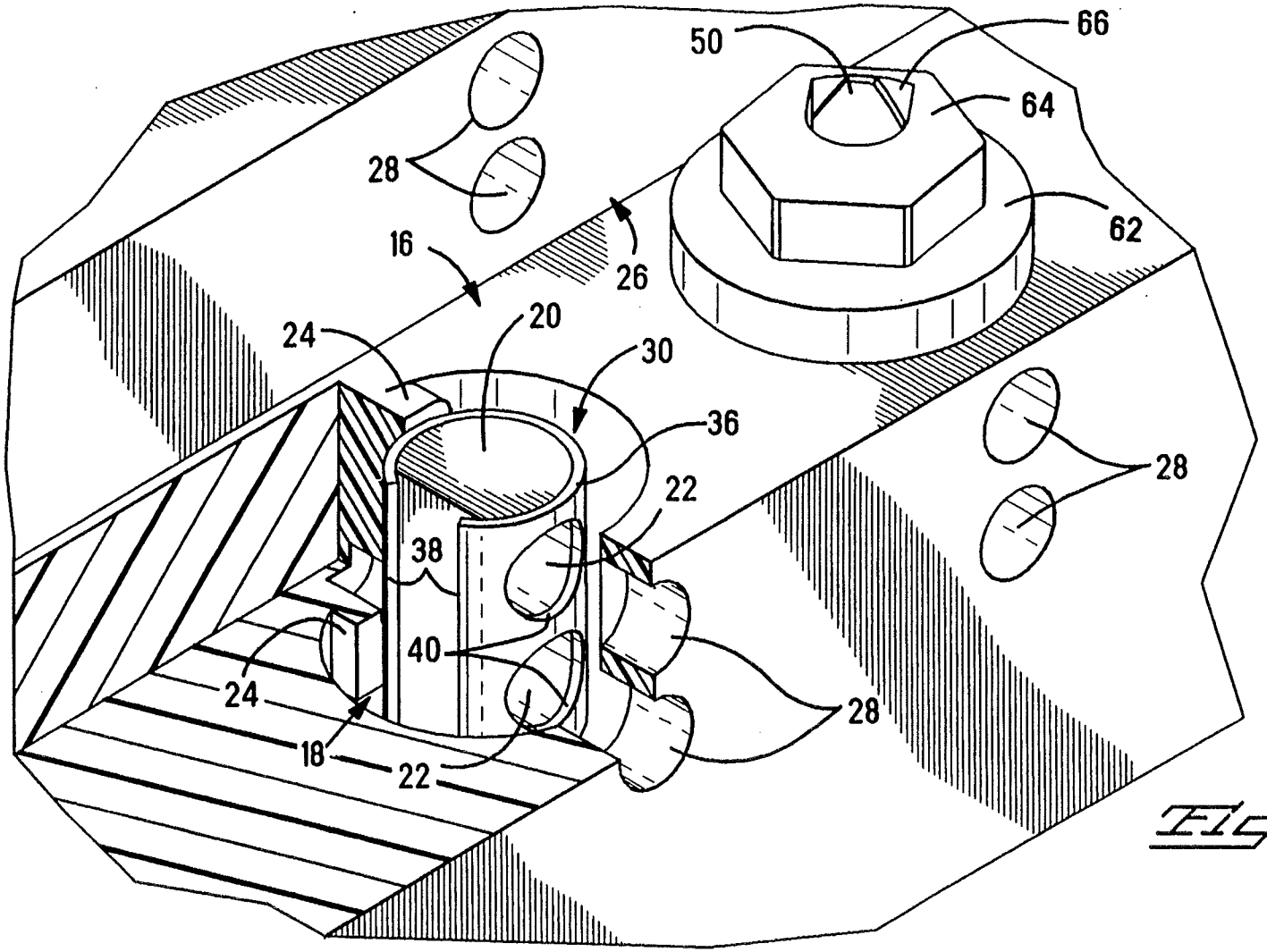
FIG. 2 is an enlarged fragmentary view of the molded housing, taken along line 2—2 of FIG. 9 with a portion of the block broken away to show the internal structure thereof.
Figure 3:
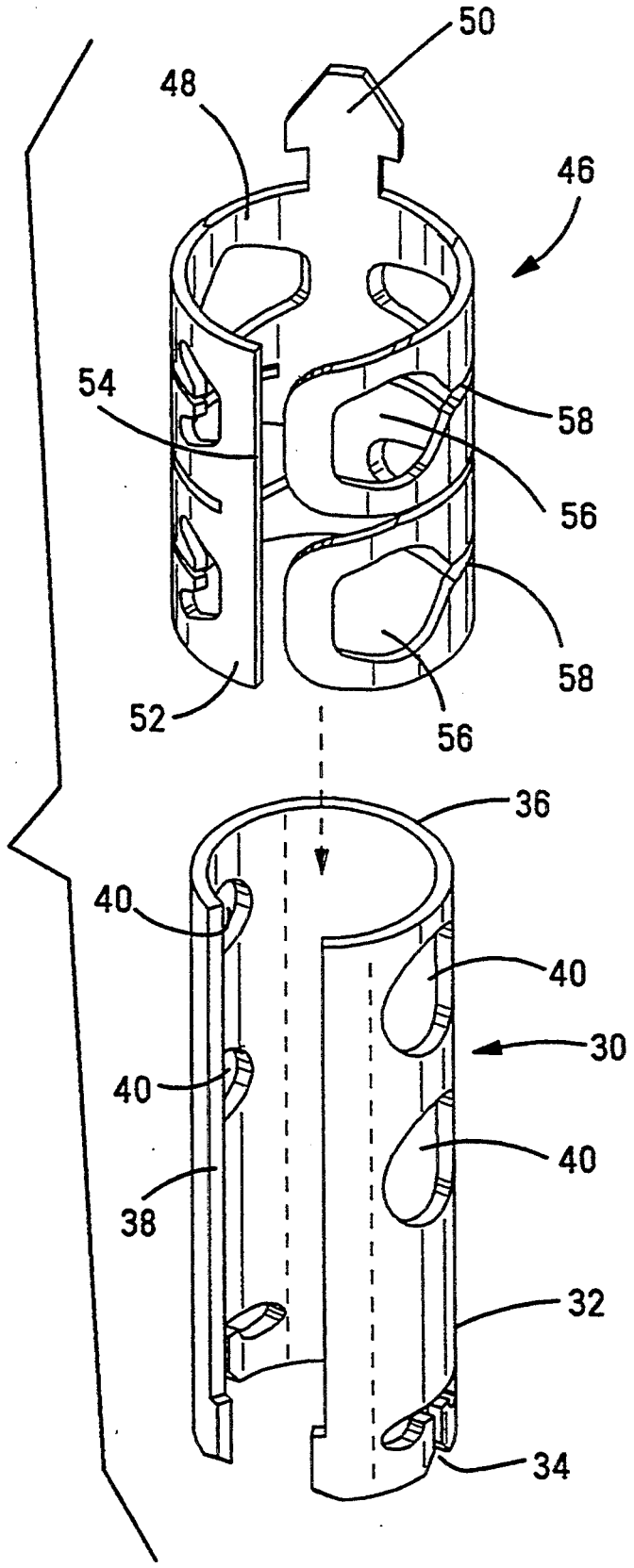
FIG. 3 is an enlarged view of the stationary and moveable terminal members used in the terminal block of FIG. 1, taken along the line of FIG. 1.
Figure 4:
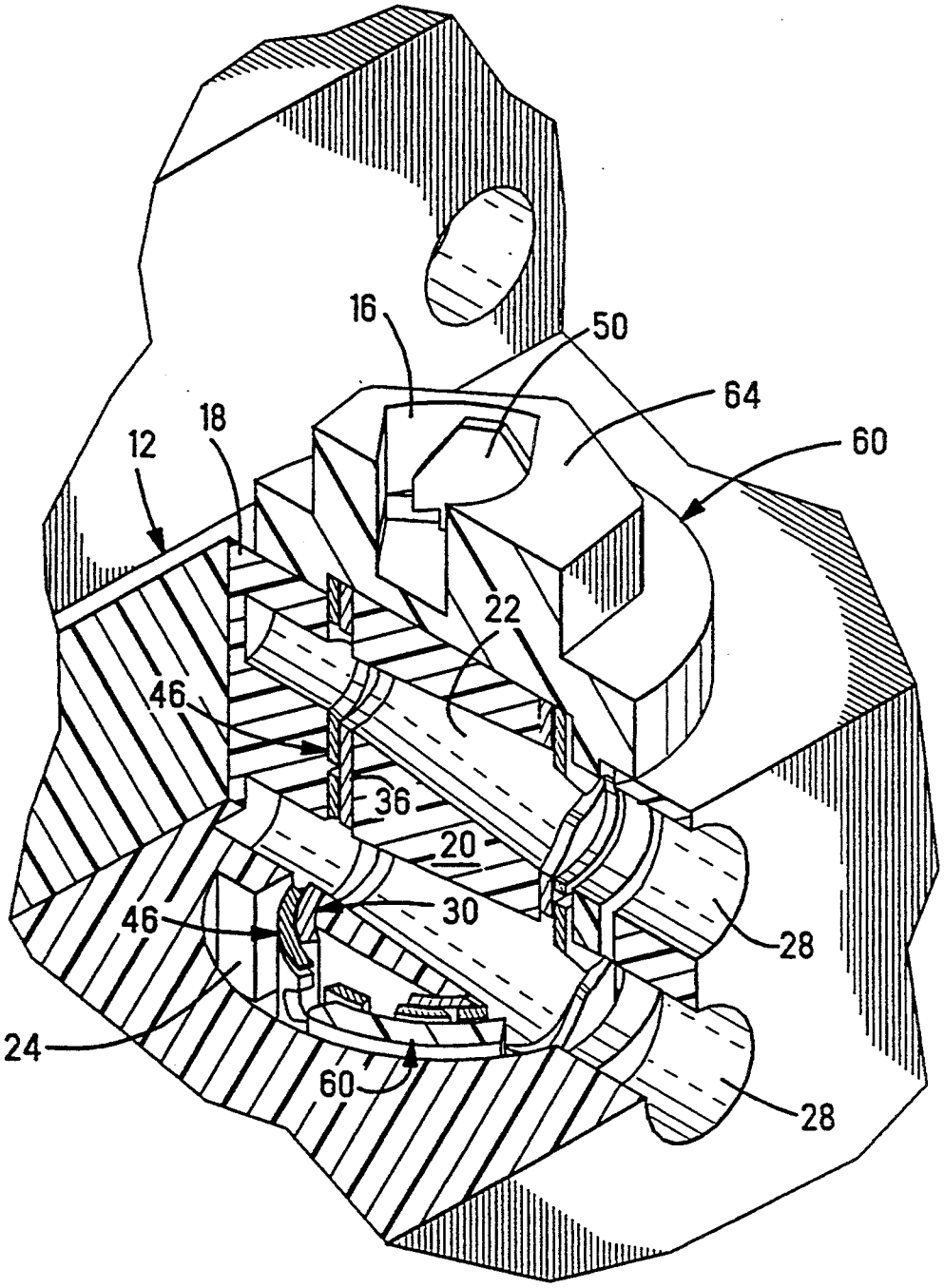
FIG. 4 is a cross-sectional view taken along lines 4—4 of FIG. 1.
Figure 6:
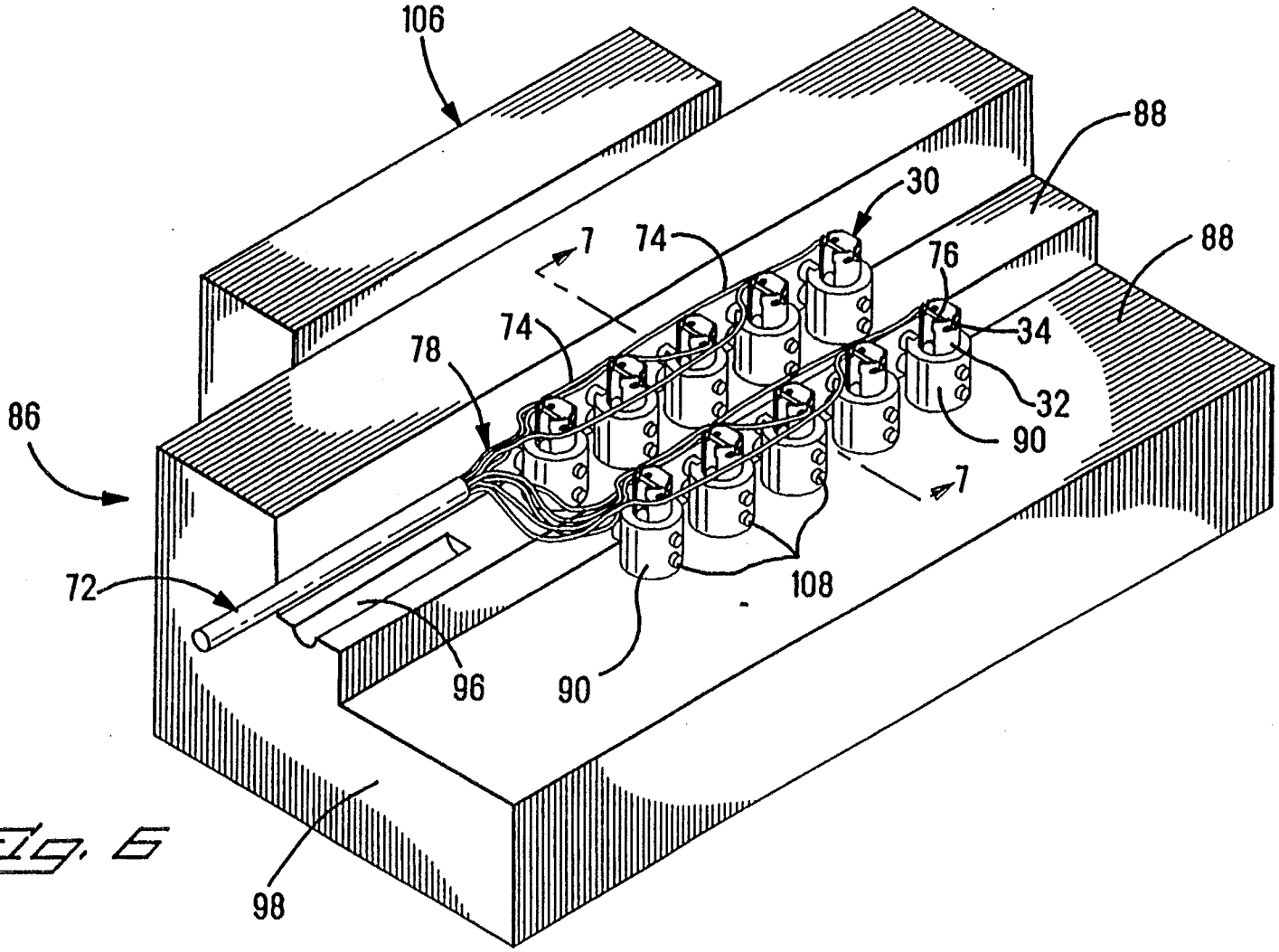
FIG. 6 is a perspective view of the mold of FIG. 5 showing the wire harness in place prior to the closing of the mold.

Referring now to FIGS. 1, 2, 3 and 4, the electrical connector assembly or terminal block 10 of the present invention comprises a housing 12 molded around a harness assembly 78, as shown in FIG. 6, including a cable 72 having a plurality of wires 74 each wire 74 being terminated to a first or stationary terminal member 30, a like plurality of second or moveable terminal members 46 and a like plurality of actuators 60 for moving each of the second terminal members 46 relative to the first terminal members during termination of a second wire 80. Housing 12 includes a transverse base 14 and a plurality of cavities 18 extending therein from an actuation face 16 of housing 12. Each of the cavities 18 is associated with one of the first or stationary terminal members 30. In the preferred embodiment cavities 18 further include a center post 20 and a stop surface 24 as best seen in FIGS. 2 and 4. Each of the cavities 18 include at least one wire receiving aperture 28 extending from a wire receiving face 26 into the cavity 18 and through a corresponding opening 22 in post 20, as shown in FIGS. 2 and 4.

First terminal members 30 include a first end 32 having a wire termination slot 34 therein, a second end 36, side edges 38 and wire receiving openings 40 extending through the side edges 38, as best seen in FIG. 3. The second terminal members or moveable terminal members 46 include a first end 48 having a tab 50 extending outwardly therefrom, side edges 54, at least one wire receiving hole 56 and wire receiving slot 58 extending therefrom. In the preferred embodiment, second terminal members have two wire-receiving slots 56 and two slots 58.

The actuating member 60, as shown in FIG. 1, includes a top 62 having a driver nut 64 and an opening 66 for receiving a tab 50 of second terminal member 46 and a cylindrical portion 68 ending in stop surfaces 70.

Harness assembly 78, as shown in FIG. 6 includes a plurality of first wires 74 having first end 76 terminated within the wire termination slots 34 at the first end 32 of respective first terminal members 30.

Figure 5:
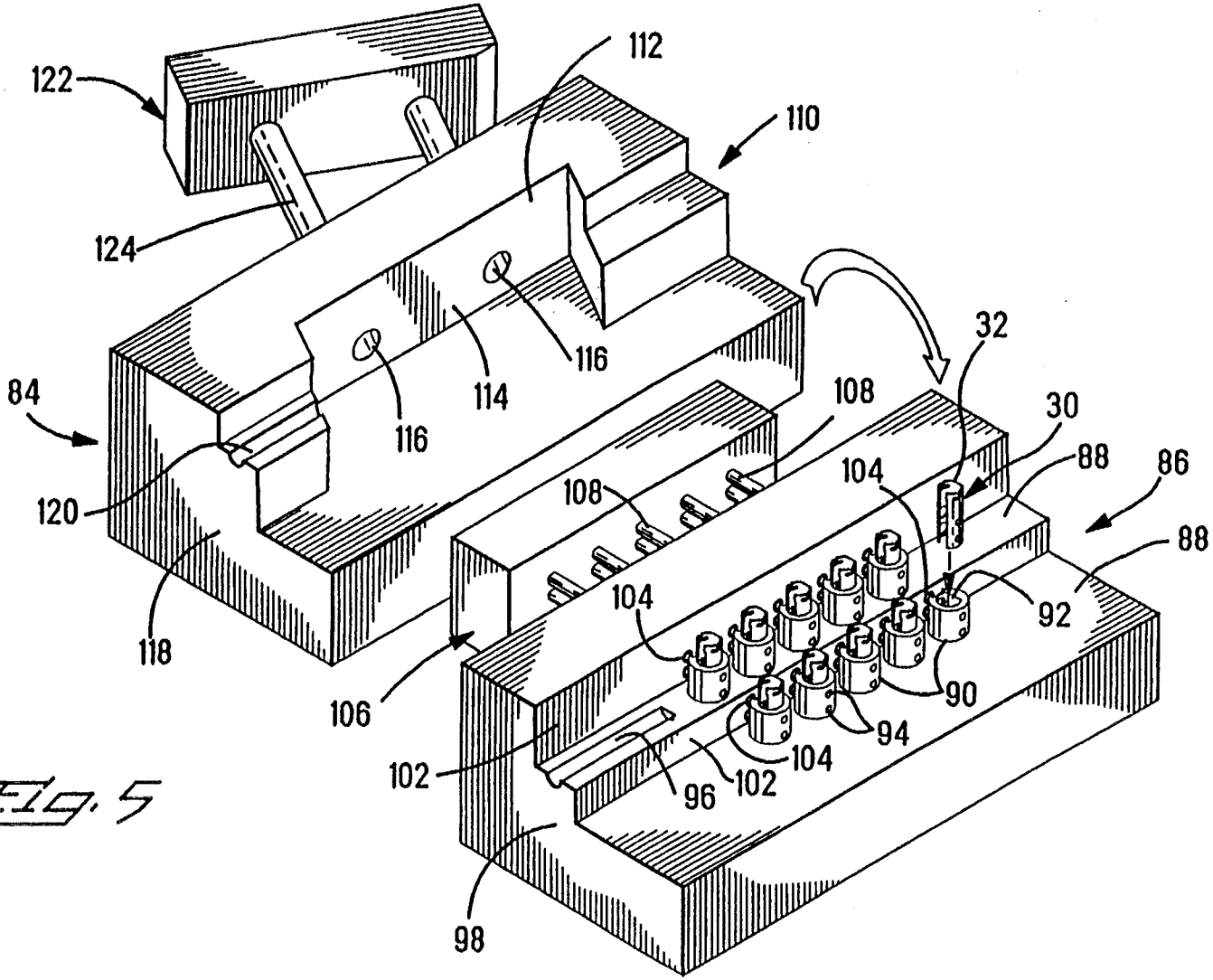
FIG. 5 is a perspective view of an open mold showing a fixturing surface in which the first or stationary terminals are in place with one of the terminals exploded from the fixture.
Figure 7:
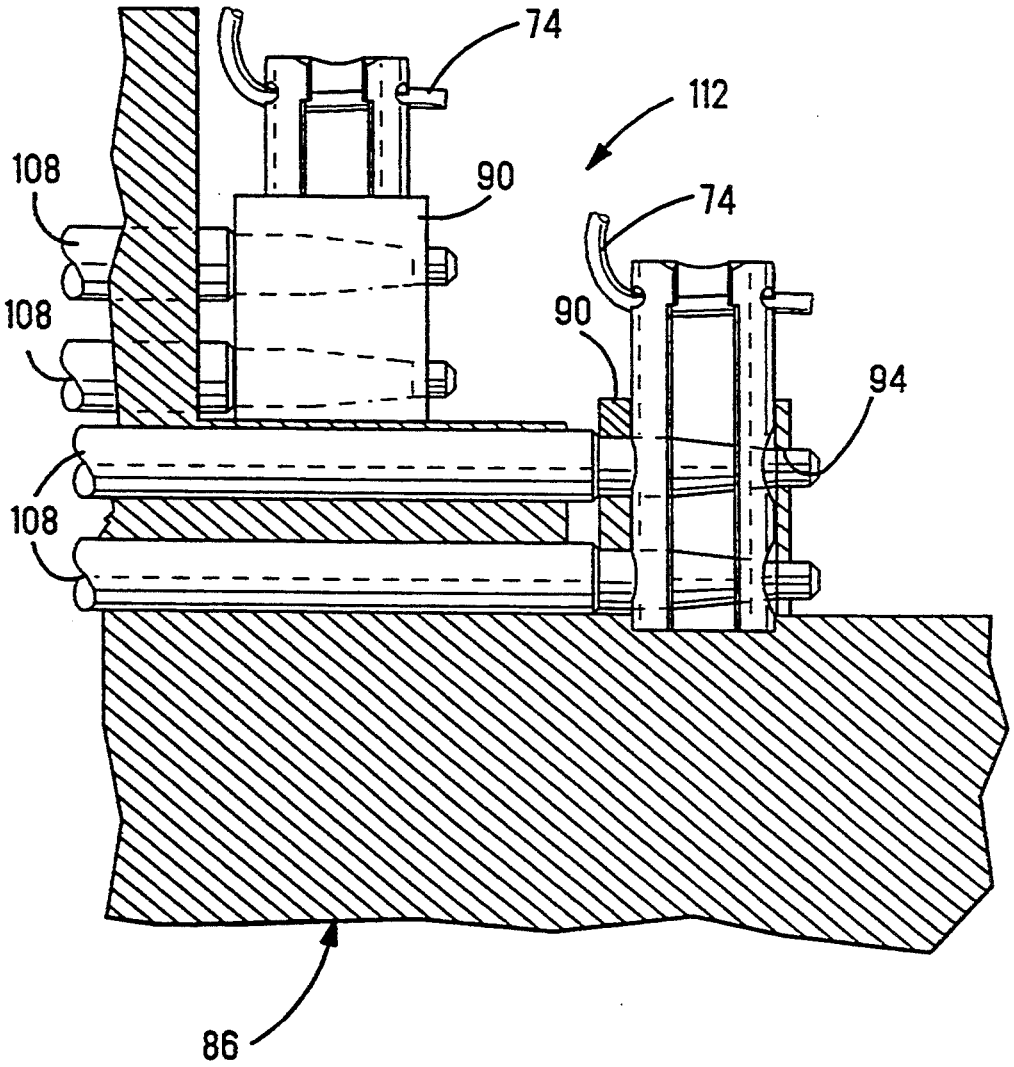
FIG. 7 is a cross-sectional view taken along lines 7—7 of FIG. 6.

FIGS. 5, 6, and 7 illustrate a mold 84 for forming housing 12 with harness assembly 78 incapsulated therein. Mold 84 includes a first mold section 86 and second mold section 110. First mold section 86 includes a fixture surface 88 having a plurality of terminal receiving cavities 92 therein. Each of the cavities 92 has core pin receiving passageways 94 which are aligned with respective wire receiving openings 40 of first terminal members 30. First mold section 86 further includes a cable receiving channel portion 96 for receiving the cable 72 of cable harness 78 upon termination of the wire end 76 to the first ends 32 of first terminal members 30, as best seen in FIG. 6. First mold section 86 further includes a core pin block 106 having a plurality of core pins 108 equivalent to the number of core pin passageways 94 in the respective cavities 92. As best seen in FIGS. 6 and 7, core pins 108 extend through respective core pin apertures 104 in backwall 102 of mold section 86 and extend outwardly from the silos 90 as shown in FIGS. 6 and 7.

Figure 8:
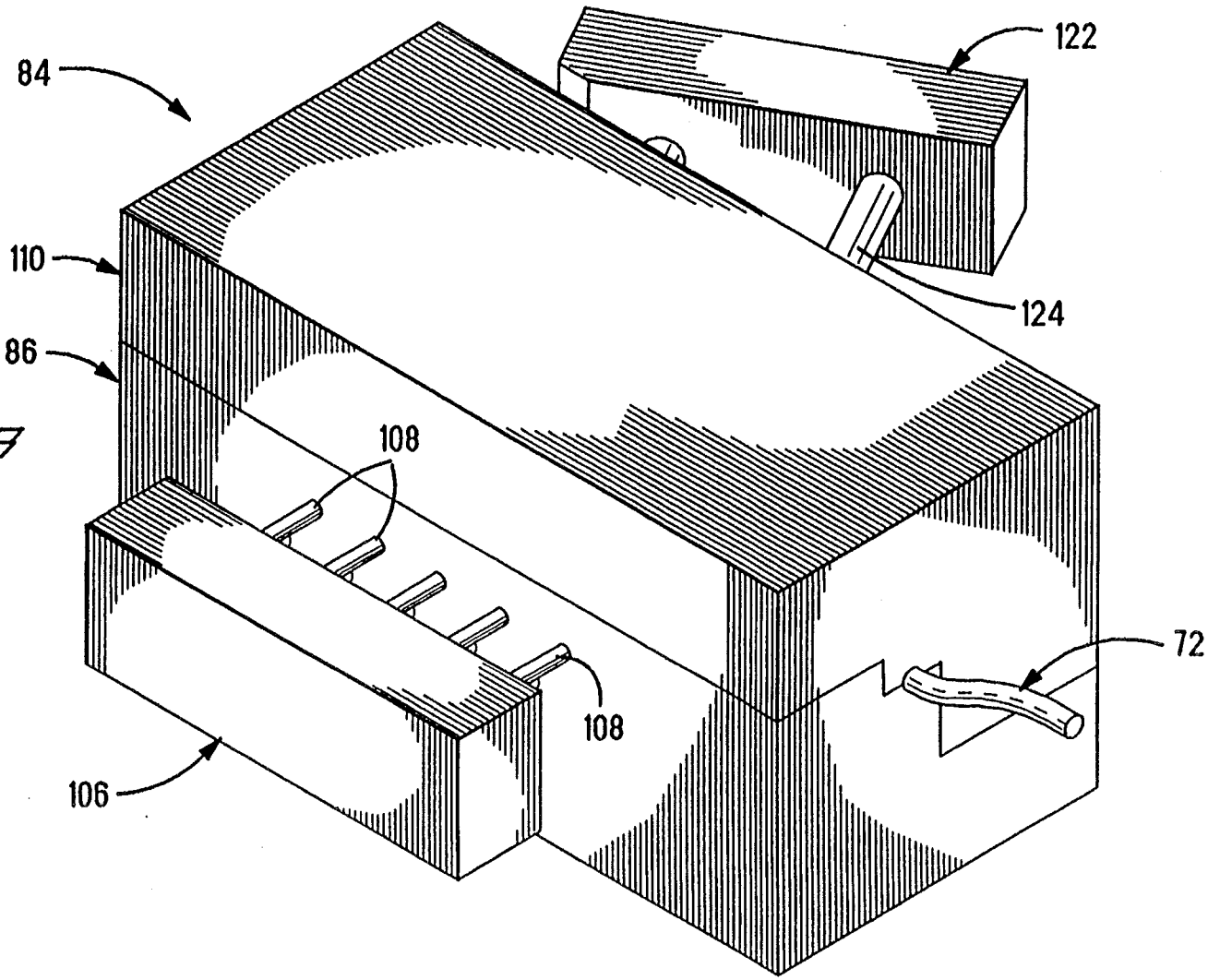
FIG. 8 is a perspective view of a closed mold.

Second mold section 110 as shown in FIG. 5, includes a backwall 114 having a plurality of apertures 116 extending therethrough for receiving push out pins 124 attached to a push out block 122. Second mold section 110 further includes the remaining cable channel portion 120 such that upon closing the first and second mold sections 86,110 as shown in FIG. 8, the cable 72 extends between the sidewalls 98,118 and the cavity 112 formed by the inner configurations of the two mold sections 86,110 thereby defining the shape of the connector housing 12. The preferred method of molding is by reaction injection molding (RIM) process wherein liquid materials are injected under low pressure into the closed mold 84, react within the mold 84 to form the desired shape. The liquid materials are mixed just prior to insertion into the mold. To ensure an even distribution of the liquid material into the mold the mixture is injected into a fan-shaped sprue and then into the mold cavity. In the presently preferred embodiment the liquid components are an isocyanate and a polyol resin that polymerize to a solid polyurethane. Suitable materials are available from Mobay Corporation under the trade names Baydur 726—Component A and Baydur 726—Component B. It is to be understood other RIM materials such as other low porosity polyurethanes, polyureas, nylons or the like may also be used.

The reaction injection molding (RIM) occurs under a mold pressure of about 600 psi thus assuring that the wires of the harness assembly 78 and first terminal members 30 remain in the desired positions as shown in FIG. 6. The reaction time for polymerization to occur when using the materials described above is on the order of two minutes, thus enabling quick turn around for the mold.

Figure 9:
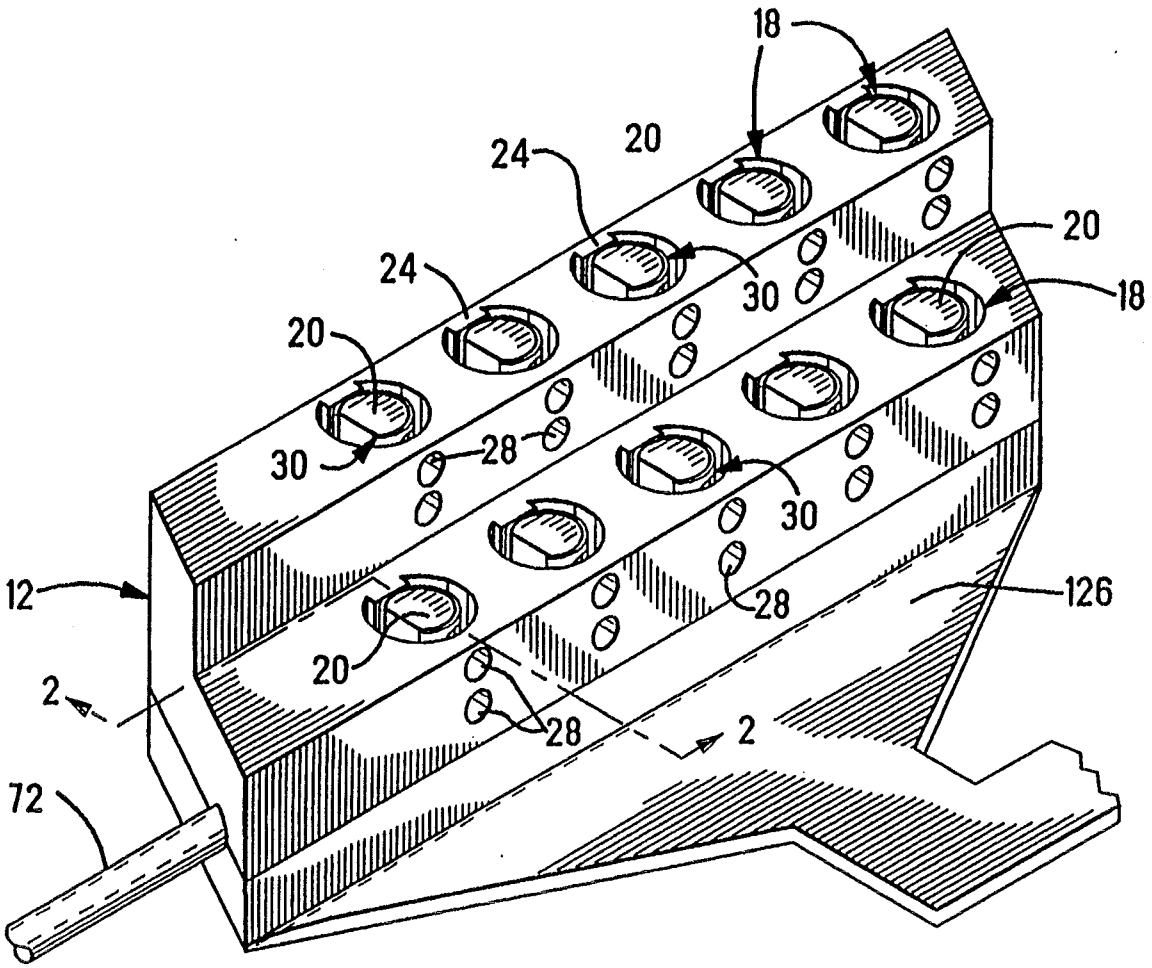
FIG. 9 is a perspective view of the molded terminal block after removal from the mold, including the fan shaped injection and mixing sprue.

When the polymerization reaction is completed the core pins 108 are removed from the molded housing 12 by pulling back on pin block 106. The mold is then opened. The finished housing 12 is retained on the second mold portion 110. The pushout block 122 is engaged to move the pushout pins 124, to force the housing 12 and remove it from the mold. The housing 12 such as shown in FIG. 9 is formed having a flashing 126 which is then broken off to form the basic housing 12 as shown in FIG. 1.

Upon completion of the molding of the housing 12 including the wire harness assembly 78 and the stationary terminal members 30, the moveable terminal members 46 are inserted into respective ones of the actuation members 60 and secured therein by inserting tab 50 within aperture 66. The sides of the actuator 68 include slots 69 that correspond to the distance between the wire receiving holes and wire receiving slots 56,58 of the second terminal members 46. The second terminal members 46 and actuation members 60 are then inserted into the respective cavities 18 until each of the moveable terminals 46 is seated in position as shown in FIGS. 1 and 4. Electrical connection between the first and second terminal members 30,46 is assured by an interference fit wherein the first terminal member 30 has a slightly larger diameter than the second terminal member 46. Upon insertion of a wire 80 through one of the wire receiving apertures 28 in wire receiving face 26 of housing 12, the end of the wire 80 is secured in a corresponding wire receiving openings 40,56 in the first and second terminal members 30,46 respectively. As the second terminal member 46 is rotated clockwise, from the first to the second position by the actuation member 60, the second terminal member 46 is moved onto the wire such that the wire receiving slot is brought into engagement with the wire 80, thereby terminating wire 80. This process is more fully described, in U.S. Pat. No. 5,120,245, which is incorporated by reference herein.

As can be understood by the foregoing discussion, the termination of the first wires 74 to the first terminal members 30 are sealed within the housing member 12 at the time the housing member is molded. Thus problems associated with secondary operations including terminating wires of a cable to terminals already in a housing and subsequent sealing of the terminations with grease, potting material or the like are eliminated. In the present embodiment the wires at the other end of the cable 72 can be spliced to desired wires (not shown) or to a connector (not shown). Terminal block 10 can be mounted to the post or other support surface by means of bolts inserted into holes (not shown) in the back of the housing 12.

It is thought that the electrical terminal block of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. An electrical connector assembly comprising:

a harness assembly including a cable having a plurality of first wires extending from an end thereof, each first wire having a first electrical terminal member terminated to a first end thereof;

a housing integrally molded around said harness assembly and embedding all exposed portions of conductors of said first wires, said housing having a transverse base and a plurality of cavities extending therein from an actuation face of said housing, each of said cavities being associated with one of said first terminal members, said molded housing exposing portions of said first terminal members within respective said cavities;

a like plurality of second terminal members, each second terminal member being complementary to a said first terminal member and electrically engaged with said exposed portions thereof upon insertion thereof into a respective one of said cavities from said actuation face; and a like plurality of actuator members associated with said second terminal members, each actuator member being insertable into a respective one of said cavities from said actuation face and in operative engagement with a respective said second terminal member;

said second terminal members upon insertion into said cavities being movable therein from a first position to a second position in a path by moving said actuator members from a first position to a second position;

said housing further including at least one wire receiving aperture associated with each said second terminal member extending into a wire receiving face thereof orthogonal to said path and in communication with a respective one of said cavities, said second terminal members each including at least one wire receiving aperture in alignment with each said wire receiving aperture of said housing when in said first position, said second terminal members further including a wire receiving slot extending parallel to said path from each said wire receiving aperture for receiving a second wire thereinto when said second terminal member is moved to said second position thus terminating a second wire, whereby the terminations of the first wires to the first terminal members are integrally sealed within said housing upon molding thereof without the need for potting, thereby simplifying manufacturing and assembly of the connector assembly.

2. The connector assembly of claim 1 wherein said first and second terminal members are cylindrical and each said second terminal member co-extends along and around a respective one of said first terminal members, each said first terminal member further having a wire receiving aperture in alignment with a respective one of said at least one wire receiving aperture of said housing and a respective one of said at least one wire receiving aperture of said second terminal member.

3. The connector assembly of claim 2 wherein said housing includes a center post disposed within and supporting each said first terminal member, each said center post having a wire receiving aperture in alignment with a respective one of said at least one wire receiving aperture of said housing and a respective one of said at least one wire receiving aperture of said second terminal member.

4. The connector assembly of claim 1 wherein said housing includes two wire receiving apertures extending into said wire receiving face and each of said second terminal members include two wire receiving apertures in alignment with said wire receiving apertures of said housing.

5. The connector assembly of claim 4 wherein said first and second terminal members are cylindrical and each said second terminal member co-extends along and around a respective one of said first terminal members, each said first terminal member further having a wire receiving aperture in alignment with each of said two housing and said two second terminal wire receiving apertures.

6. The connector assembly of claim 5 wherein said housing member includes a center post disposed within and supporting each said first terminal member, each said center post having wire receiving apertures in alignment with a respective one of said two housing and said two second terminal wire receiving apertures.

7. A method for making an electrical connector assembly comprising the steps of:

providing a harness assembly including a cable having a plurality of first wires extending from an end thereof, each first wire having a first electrical terminal member terminated to a first end thereof;

integrally molding a housing around said harness assembly such that all exposed portions of conductors of said first wires are embedded in said housing, said molded housing having portions of said first terminal members exposed within respective cavities extending into said housing from an actuation face thereof;

inserting a like plurality of second terminal members into a respective one of said cavities from said actuation face, each second terminal member being complementary to a said first terminal member and electrically engaged with said exposed portions thereof; and inserting a like plurality of actuator members into a respective one of said cavities from said actuation face and in operative engagement with a respective said second terminal member;

whereby the terminations of the first wires to the first terminal members are integrally sealed within said housing upon molding thereof without the need for potting, thereby simplifying manufacturing and assembly of the connector assembly.

* * * * *